US007357585B2

(12) United States Patent
Kurashina

(10) Patent No.: US 7,357,585 B2
(45) Date of Patent: Apr. 15, 2008

(54) PRINTING TAPE, TAPE CARTRIDGE PROVIDED THEREWITH, AND TAPE PRINTING APPARATUS

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 264 days.

(21) Appl. No.: 11/154,301

(22) Filed: Jun. 16, 2005

(65) Prior Publication Data

US 2006/0008608 A1 Jan. 12, 2006

(30) Foreign Application Priority Data

Jul. 8, 2004 (JP) ..... 2004-201693

(51) Int. Cl.
*B41J 11/70* (2006.01)
*B41J 11/68* (2006.01)
*B41J 3/36* (2006.01)

(52) U.S. Cl. ..... 400/621; 400/88

(58) Field of Classification Search ..... 400/612
See application file for complete search history.

(56) References Cited

U.S. PATENT DOCUMENTS 5,556,213 A * 9/1996 Kudo et al. ..... 400/621
5,854,647 A * 12/1998 Ohtsuka ..... 347/101
6,017,408 A * 1/2000 Rogers et al. ..... 156/249
6,113,294 A 9/2000 Niwa ..... 400/621
6,238,036 B1 * 5/2001 Ohtsuka ..... 347/37
6,352,608 B1 * 3/2002 Garden ..... 156/249
6,669,020 B1 * 12/2003 Mamiye ..... 206/438
6,874,421 B2 * 4/2005 Kitchin et al. ..... 101/492
2002/0094222 A1 * 7/2002 Furuya et al. ..... 400/615.2
2002/0154933 A1 * 10/2002 Kalette ..... 400/615.2
2004/0022983 A1 * 2/2004 Bayzelon et al. ..... 428/40.1
2004/0208682 A1 * 10/2004 Akaiwa et al. ..... 400/613
2005/0180795 A1 * 8/2005 Kurashina ..... 400/611
2005/0244595 A1 * 11/2005 Hagen et al. ..... 428/34.1
2006/0008608 A1 * 1/2006 Kurashina ..... 428/43
2006/0292319 A1 * 12/2006 Kurashina et al. ..... 428/32.64
2007/0006963 A1 * 1/2007 Bever ..... 156/213

FOREIGN PATENT DOCUMENTS

JP 06-286241 10/1994
JP 7-2203 1/1995
JP 07-061100 3/1995

(Continued)

*Primary Examiner*—Daniel J. Colilla
(74) *Attorney, Agent, or Firm*—Hogan & Hartson LLP

(57) ABSTRACT

A printing tape has a translucent recording-tape layer with a recording surface on a face thereof, and a translucent pseudo-laminating layer adhered to a back of the recording-tape layer. The pseudo-laminating layer has an adhesive-agent layer on a face thereof and a translucent tape layer on a back thereof. The recording-tape layer has a print-recording piece whose face serves as a printing region and a cut-off piece to be peeled off from the adhesive-agent layer. The print-recording piece is separated from the cut-off piece by a long-side cutting line formed in a longitudinal direction of the recording surface. By inverting both the recording-tape layer and the pseudo-laminating layer inside out for adhering to an object of adhesion after removing the cut-off piece, the pseudo-laminating layer serves as a laminate tape for the recording surface.

4 Claims, 7 Drawing Sheets

FOREIGN PATENT DOCUMENTS

| | | |
|---|---|---|
| JP | 10-217550 | 8/1998 |
| JP | 11-277823 | 10/1999 |
| JP | 2003-114620 | 4/2003 |
| JP | 2003-341686 | 12/2003 |
| JP | 2004-114550 | 4/2004 |

* cited by examiner

PRINTING TAPE, TAPE CARTRIDGE PROVIDED THEREWITH, AND TAPE PRINTING APPARATUS

BACKGROUND OF THE INVENTION

1. Field of the Invention

This invention relates to a printing tape which partially serves as a laminate tape, a tape cartridge, and a tape printing apparatus.

2. Description of the Related Art

Conventionally, there are two kinds of tape cartridges, one having contained a printing tape and an ink ribbon inside a cartridge case in a manner to be freely pulled out therefrom, and the other having contained a printing tape, a laminating tape and an ink ribbon inside a cartridge case in a manner to be freely pulled or paid out therefrom. These two kinds of tape cartridges are respectively loaded into an exclusively used tape printing apparatus. In the former example, the printing onto the printing tape and the tape cutting are performed to thereby prepare a label. In the latter example, the printing on the printing tape, the adhesion of the laminating tape, and the tape cutting are performed to prepare a laminated printing tape.

In the latter example of the tape printing apparatus, it is possible to prepare a label without lamination by loading a tape cartridge in which the laminating tape is omitted. In the former example, on the other hand, there is no mechanism for adhering the printing tape and the laminating tape together. Therefore, even if a tape cartridge having added thereto the laminating tape is loaded, a laminated printing tape cannot be prepared.

SUMMARY OF THE INVENTION

In view of the above-described problem, this invention has an advantage of providing a printing tape which is capable of laminating the printed surface with a printing tape itself after printing, without providing a tape printing apparatus with a mechanism for paying out a laminate tape and laminating it with the printed tape. This invention also provides a tape cartridge and a tape printing apparatus for mounting thereon the tape cartridge.

According to one aspect of this invention, there is provided a printing tape comprising: a translucent recording-tape layer having a recording surface on a face thereof; and a translucent pseudo-laminating layer adhered to a back of the recording-tape layer. The pseudo-laminating layer has an adhesive-agent layer on a face thereof and a translucent tape layer on a back thereof. The recording-tape layer has a print-recording piece whose face serves as a printing region and a cut-off piece to be peeled off from the adhesive-agent layer. The print-recording piece is separated from the cut-off piece by a long-side cutting line formed in a longitudinal direction of the recording surface. Both the recording-tape layer and the pseudo-laminating layer are adhered, after removing the cut-off piece, to an object of adhesion in a state of inverting inside out such that said pseudo-laminating layer serves as a laminate tape for the recording surface. The term "pseudo-laminating layer" is used in this specification to mean a layer which finally serves the purpose of a laminating layer but which serves, on the way of processing or using, a temporary purpose other than that of the laminating layer.

According to the above-described arrangement, printing on the surface of the print-recording piece is performed and then the cut-off piece is released from the adhesive-agent layer. Thereafter, by inverting the printing tape inside out, there can be formed a laminated printing tape whose printed surface can be laminated by the printing tape itself. In addition, since the printing tape has the adhesive-agent layer, it can be adhered as it is, after printing, to an object of adhesion. The translucent pseudo-laminating layer may be made not only of a transparent base material, but also of a whitish translucent base material.

Preferably, the long-side cutting line is made up of two parallel cutting lines so as to form the print-recording piece and a pair of cut-off pieces which lie on both widthwise sides of the print-recording piece.

According to the above-described arrangement, the cut-off piece portions which serve as the margin for adhesion are formed in a pair with the print-recording piece whose face serves as the printing surface being sandwiched therebetween. Therefore, without making the entire surface as the adhesive surface, widthwise both end portions of the tape can be used as portions for adhesion. The printing tape as adhered to an object of adhesion becomes hard of being peeled off.

Preferably, a ratio between a width of the print-recording piece and a width of the cut-off pieces is about 2:1.

According to the above-described arrangement, since the print-recording piece and the cut-off piece are formed in a ratio of about 2:1 in width, the printing tape can be prevented from becoming easily peeled off due to too small an adhesive region as compared with the printing region. The printing region can also be prevented from becoming small due to too large an adhesive region as compared with the printing portion. The printing region and the adhesive margin can thus be formed in an appropriate ratio.

Preferably, the cut-off piece has operating information about the peeling operation printed on a face thereof.

According to the above-described arrangement, the user can perform the peeling operation while referring to the operating information about the peeling operation. The user can easily form the laminated printing tape without wrong peeling operation. As the operating information, there may be used patterns such as symbols, shading, oblique lines, or the like, aside from the characters.

According to another aspect of this invention, there is provided a tape cartridge comprising: the above-described printing tape in a state of being rolled into a roll; and a cartridge case which houses the printing tape in a manner to be freely paid out therefrom.

According to the above-described arrangement, by mounting on the tape printing apparatus the above-described tape cartridge containing therein the printing tape, there can be formed a laminated printing tape which is capable of laminating, after printing, the printed surface by means of the printing tape itself. In addition, since the printing tape has the adhesive-agent layer, it can be adhered to an object of adhesion upon completion of printing.

According to still another aspect of this invention, there is provided a tape printing apparatus having detachably mounted thereon the above-described tape cartridge and performing printing on the printing tape to be paid out from the tape cartridge. The apparatus comprises: input means for inputting character string made up of one or more characters to be printed on the recording surface; data inverting means for inverting the inputted character string in a right-and-left direction (mirror-image printing); and printing means for printing on the printing region the character string as inverted by the data inverting means.

According to the above-described arrangement, printing is made on the printing tape which is capable of laminating, with the printing tape itself after printing, the printing surface having printed thereon the character string. Therefore, the laminated printing tape can be easily formed. Further, since the printing tape has the adhesive-agent layer, it can be adhered to an object of adhesion right after printing. In addition, since the printing is made with the width of the print-recording piece as the printing region (print-width region) in the widthwise direction of the tape, there is no possibility that the characters are printed on the cut-off pieces to be peeled off from the adhesive-agent layer. In addition, since the inputted character string is printed after inverting it in the right-and-left direction, in the case of the printing tape to be adhered to the object of adhesion in a state of inverting inside out, the printed character string will look toward the correct direction (become a true image) in a state of being adhered, thereby facilitating easy recognition. Preferably, the character string is printed with due centering relative to the printing region (print-width region) as seen in the widthwise direction of the tape.

Preferably, the tape printing apparatus further comprises: full-cutting means for cutting off only that portion of the printing tape on which the character string is printed; and half-cutting means for forming a cutting line by cutting the print-recording tape layer in the widthwise direction of the tape to thereby form a cutting line in a short-side direction of the tape. The cutting line is located outside the character string, as seen in the character-string direction, in the printed portion.

According to the above-described arrangement, in the printing tape after printing and cutting, a pair of first adhesion margins (cut-off pieces) are formed on both widthwise end portions of the tape by the long-side cutting line and also second adhesive margins are formed on both longitudinal end portions of the tape by the short-side cutting lines. In other words, since the arrangement is such that the printing surface is enclosed, the adhered laminated printing tape becomes harder to be peeled off. The ratio of width in the widthwise direction of the first adhesive margins and the width in the longitudinal direction of the second adhesive region shall preferably be 2:1.

Preferably, the printing means prints, in parallel with the printing of the character string, operating information about releasing operation on at least one of a face of one of the cut-off piece and a waste margin to be formed by the short-side cutting line.

According to the above-described arrangement, in the printed and cut printing tape, the user can perform the peeling operation by referring to the operating information about the peeling operation. Therefore, the laminated printing tape can be easily formed without wrong peeling operation.

Preferably, the operating information includes at least one of character information, symbol information, and background information.

According to the above-described arrangement, the operating information can be made, not only by the characters relating to the peeling operation, but also by the patterns such as oblique lines, shading, or the like.

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

With reference to the accompanied drawings, a description will now be made about a printing tape, a tape cartridge, and a tape printing apparatus according to one embodiment of this invention.

Figure 1:
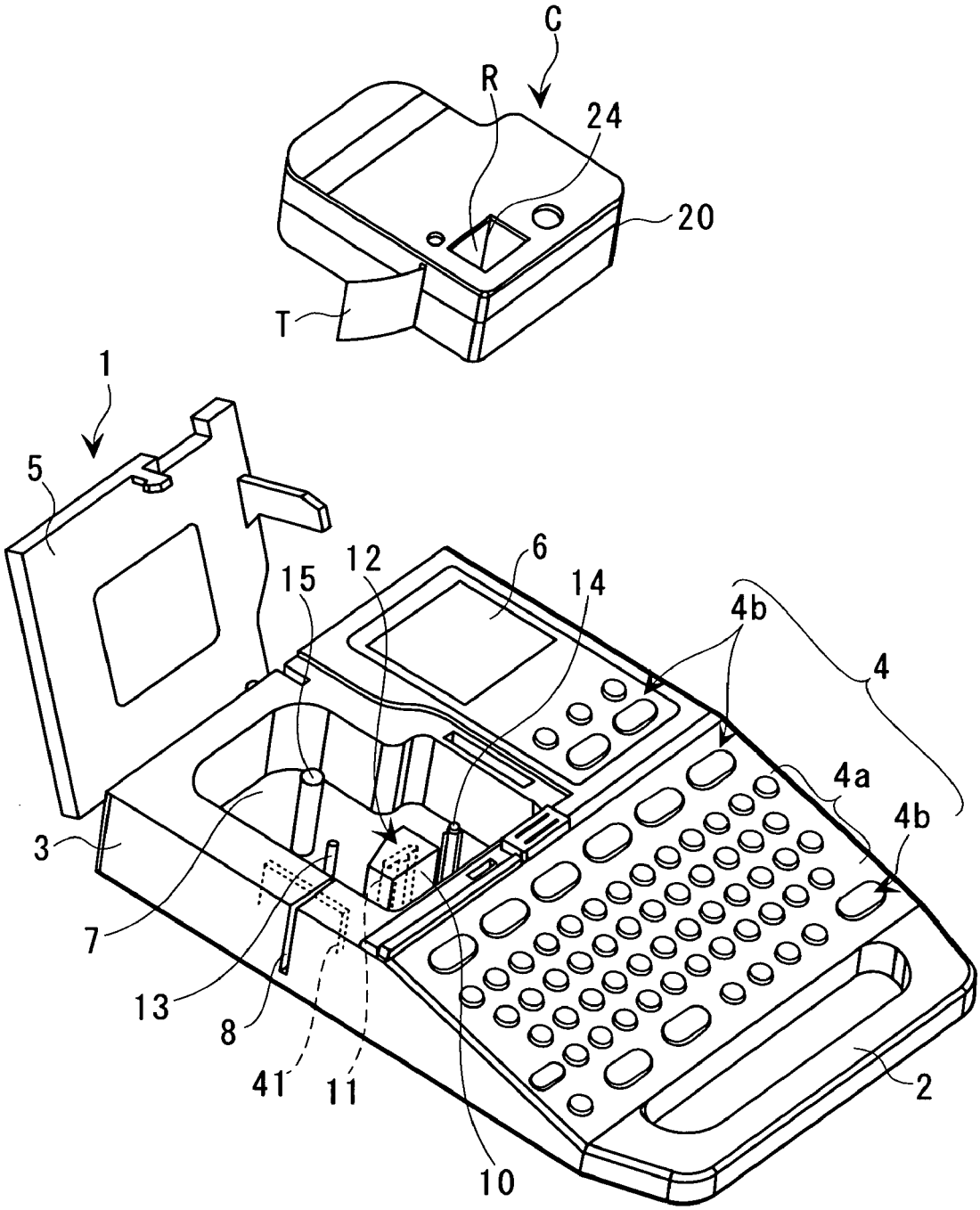
FIG. 1 is an outside perspective view of a tape printing apparatus.

FIG. 1 is an external perspective view of a tape printing apparatus 1 in a state in which a lid is left open. The tape printing apparatus 1 has an external shell which is formed by an apparatus case 3. A keyboard 4 having arranged therein various input keys is disposed in a front upper surface of the apparatus case 3, and an opening/closing lid 5 is disposed in a rear upper surface at the left-half portion thereof, and a display 6 is disposed at the right-half thereof. The term "front" means a side closer to an operator and the term "rear" means a side remote from the operator. Inside the opening/closing lid 5 is disposed a cartridge mounting block 7 for mounting therein in an embedded manner a tape cartridge C which contains therein a tape T and an ink ribbon R. The tape cartridge C is mounted in, or dismounted from, the cartridge mounting block 7 in a state in which the opening/closing lid 5 is left open.

On the left side (as seen from the viewpoint of the operator) of the apparatus case 3, there is formed a tape discharge opening 8 which communicates the cartridge mounting block 7 and the outside of the tape printing apparatus. A cutting section 130 (see FIG. 4) in which cutting of the tape T is performed is disposed between the cartridge mounting block 7 and the tape discharge opening 8. The cutting section 130 is made up of a full cutter 41 and a half cutter 42 (FIGS. 2 and 4) which is disposed on a downstream side as seen in the direction of feeding the tape into the full cutter 41. The full cutter 41 is of a scissors-type having a movable blade and a stationary blade and is to full-cut both a recording-tape layer 80 and a pseudo-laminating layer 90 (see FIG. 5A, to be described in detail hereinafter) by motor drive (with a full-cutter motor 31, see FIG. 4), namely, to fully cut the tape. As a result of this full cutting, the tape T is cut off at the rear end of the printed portion and is discharged out of the tape discharge opening 8. The term "print-recording layer" means a layer on which printing is made to keep the printed image as a record.

Figure 2:
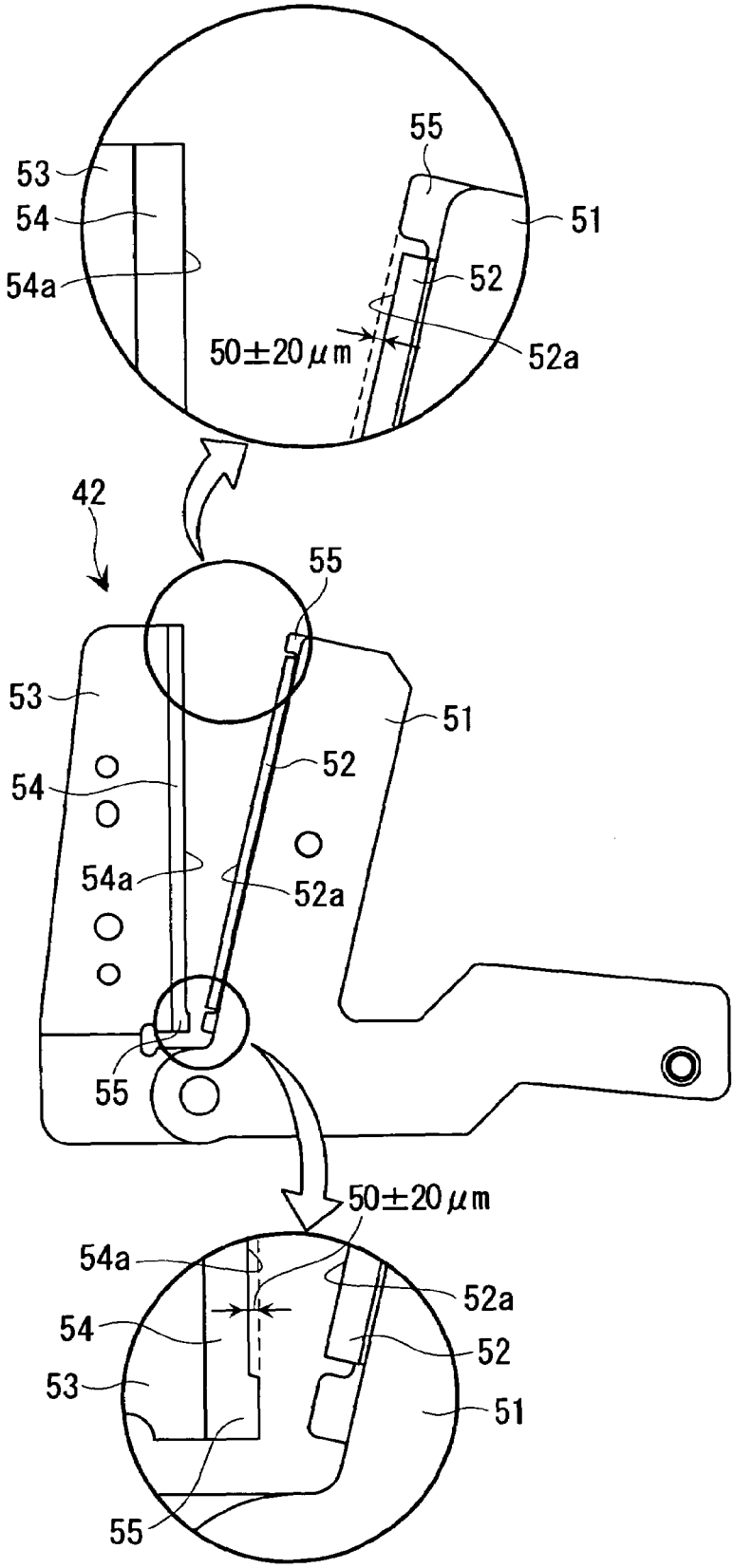
FIG. 2 is a front view of a half cutter.

As shown in FIG. 2, the half-cutter 42 is made up of: a cutting blade 51 having a straight blade 52; and a blade receiving member 53 having a blade-tip receiving portion 54 which lies parallel with the blade line of the cut (or moved-forward) blade 52 and receives the cutting blade 51. In the same manner as above, by driving with a motor (half-cutter motor 32, see FIG. 4), the cutting blade 51 is forced against the blade receiving member 53 (forced shear cutting type). Only the recording tape layer 80 of the tape T is thus cut while leaving the pseudo-laminating layer 90 intact, i.e., the tape T is partially cut or half-cut as seen in the thickness direction of the tape. Therefore, even in case, like in this embodiment, the recording tape layer 80 and the pseudo-laminating layer 90 are respectively made of a plastic film (to be described in detail hereinafter) and both layers have equal bending rigidity, the half-cut portion can serve as a starting clue in peeling, so that the cut-off piece 82 which serves as a release piece can be easily peeled off.

The half cutter 42 is provided with a pair of projections 55, 55 which are positioned at the front-end side of the cutting blade 51 and at the base-end side of the blade-receiving member 53 so as to positionally restrict the clearance between the blade tip 52*a* of the moved-forward blade 52 and the blade-receiving surface 54*a* of the blade receiving member 54. As a result, the half cutter 42 is controlled in the following manner. Namely, the clearance between the blade tip 52*a* of the moved-forward blade 52 and the blade-receiving surface 54*a* of the blade receiving member 54*b* is restricted to a predetermined distance (50 μm±20 μm) so that the half cutter 42 cuts the recording tape layer 80 completely (i.e., to the rear side thereof) but does not cut the pseudo-laminating layer 90 (at least does not cut to the rear side thereof). Therefore, at least the amount equivalent to 30 μm on the rear side of the pseudo-laminating layer 90 of the half-cut portion is arranged to remain uncut (even in case the above-described clearance is 30 μm).

Figure 4:
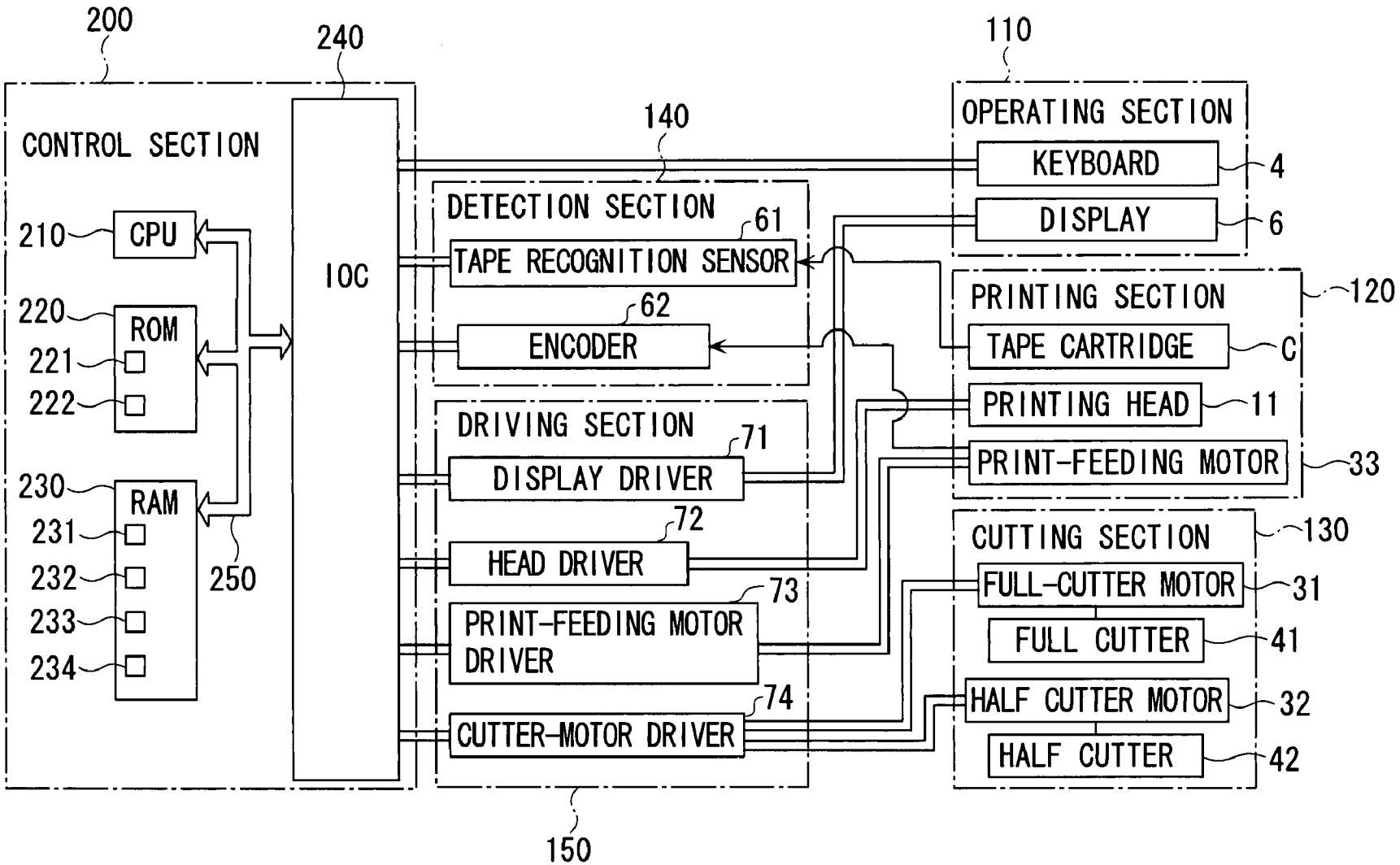
FIG. 4 is a block diagram of the tape printing apparatus.

With reference once again to FIG. 1, the keyboard 4 is used to input various commands and data into control section 200 (FIG. 4, to be described in detail hereinafter). The input key has arranged therein: character key group 4*a* inclusive of alphabetical key group, numeral key group, and Japanese "kana" key group; and function key group 4*b* for commanding various operations; or the like. The function key group 4*b* includes: selection key for data entry or returning at the time of text inputting, commanding selection of various modes; deletion key for deleting various inputting; shift key for changing the role of each key; four cursor keys for moving the cursor or moving the display area on the display 6; file form key for file operation and print form selection; or the like.

The display 6 is capable of displaying display image data of 96 dots×64 dots within a rectangle of about 6 cm wide (X direction) and about 4 cm long (Y direction) and is used in print data preparation and editing for performing printing through inputting by the user from the keyboard 4. In addition, various errors and messages (contents of commands) are displayed for reporting to the user.

The cartridge mounting block 7 is provided with: a head unit 12 having a thermal head inside a head cover 10; a platen driving shaft 13 lying to face the printing head 11; a take-up driving shaft 14 for taking up an ink ribbon (to be described later); and a positioning projection 15 for aligning a tape reel 21 (to be described later). Under the cartridge mounting block 7, there is housed a print-feeding motor 33 (FIG. 4) for rotating the platen driving shaft 13 and the take-up driving shaft 14.

Figure 3:
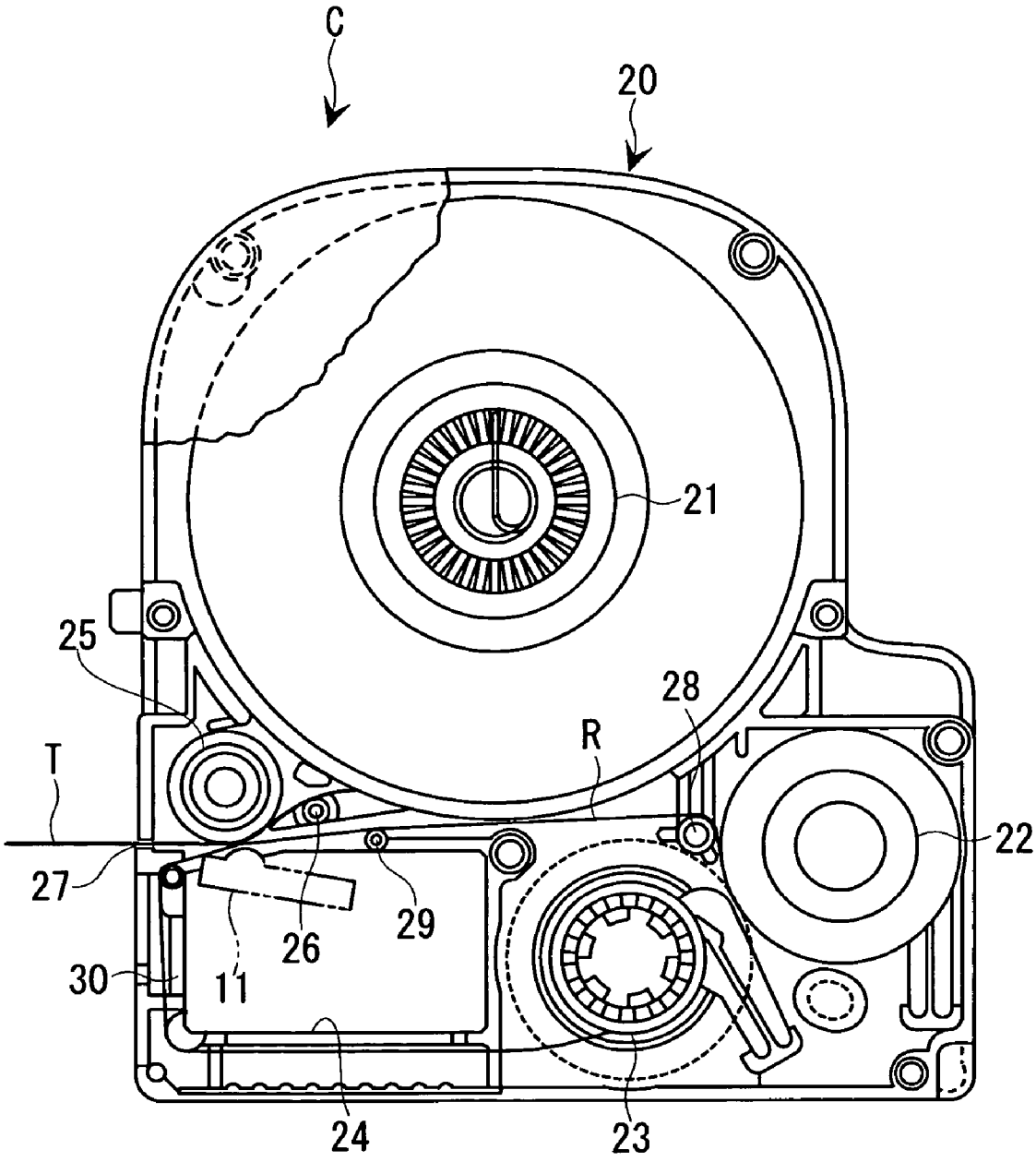
FIG. 3 is a plan view of a tape cartridge.

FIG. 3 is a plan view of a cartridge case 20. As shown therein, the tape cartridge C contains, inside an upper central portion of the cartridge case 20 (as seen in the figure): a tape reel 21 having wound the certain width of tape T; a ribbon paying reel 22 having wound the ink ribbon at the right lower portion (as seen in the figure); and a ribbon take-up reel 23 for taking up the used ink ribbon. The tape T and the ink ribbon R have the same width.

On a lower left portion (as seen in the figure) of the tape reel 21, there is formed a through hole 24 for inserting through the head cover 10. When the tape cartridge C is mounted on the cartridge mounting section 7, the printing head 11 on the side of the printing apparatus lies opposite to the through hole 24 so as to face the platen roller 25. In this state, the platen roller 25 from the printing apparatus side and the ribbon take up reel 23 are engaged with the platen driving shaft 13 and the take-up driving shaft 14, respectively. In other words, the platen roller 25 and the ribbon take-up reel 23 serve as the driving reels, and the tape reel 21 and the ribbon paying reel 22 serve as the driven reels.

The tape T paid out of the tape reel 21 is guided by a tape guide 26 to thereby reach the platen roller 25, where the tape T is printed and discharged out of the tape discharge port 27. On the other hand, the ink ribbon R paid out of the ribbon paying reel 22 is guided by a first ribbon pin 28 and a second ribbon pin 29 to thereby reach the platen roller 25. The ink ribbon R is then subjected to printing in a manner overlapped with the tape T and is further guided by an opening wall 30 which forms the through hole 24, thereby being taken up by the ribbon take-up reel 23. In this case, since the platen roller 25 and the ribbon take-up reel 23 on the driving side rotate in a manner synchronized with each other, the tape T and the ink ribbon R travel at the same time. The tape T is subjected to printing while traveling.

On the rear surface of the tape cartridge C, there are formed a plurality of small holes to facilitate the recognition of the kind of the tape T having different widths, or the like. On the cartridge mounting block 7, there is provided a tape recognition sensor 61 (FIG. 4) such as a micro switch. The presence or absence (strictly speaking, as to whether the tape cartridge C is mounted or not) and the kind of the tape T (strictly speaking, the kind of the tape cartridge C) are thus detected.

With reference to FIG. 4, a description will now be made about the control system of the tape printing apparatus 1. The tape printing apparatus 1 is made up of: an operating section 110 which controls the user interface; a printing section 120 which performs printing based on the inputted data; the cutting section 130 which cuts the tape T into a predetermined length; a detection section 140 which performs various detections; a driving section 150 which drives various members; and the control section 200 which is connected to various sections and control the entire printing apparatus 1.

The operating section 110 has the keyboard 4 and the display 6 and performs inputting by the user and displaying of various information. The printing section 120 has the tape cartridge C, the print head 11, and the print-feeding motor 33 and performs printing on the tape T based on the inputted characters while feeding the tape T and the ink ribbon R. Further, the cutting section 130 has the full cutter 41, the half cutter 42, the full-cutter motor 31, and the half-cutter motor 32 for driving the above, and subject the printed tape T to full cutting or half cutting.

The detecting section 140 has a tape recognition sensor 61 for detecting the kind of the tape T (tape cartridge C), and an encoder to detect the rotary speed of the print-feeding motor 33 to thereby perform various detections.

The driving section 150 has a display driver 71, a head driver 72, a print-feeding motor driver 73, and a cutter-motor driver 74 to thereby drive each of the sections.

The control section 200 has a CPU 210, a ROM 220, a RAM 230 and an input/output controller (IOC) 240 and are connected together by an internal bus 250. The ROM 220 has: a control program block 221 which stores therein a control program for performing various processing in the CPU 210 such as printing process, or the like; and a control data block 222 which stores therein the character font data and control data for performing printing. The character font data need not be provided inside the ROM 220, but a separate CG-ROM may be provided.

The RAM 230 has: a various work area block 231 which is used as flags, or the like; input data block 232 which temporarily stores therein characters inputted through the keyboard 4; print data block 233 which stores therein print data which is generated by developing inputted data inside the input data block 232; and display data block 234 which stores therein the display data to display on the display, and the RAM 230 is used as the working region for control processing. The RAM 230 is constantly backed up to keep the stored data even in case of power failure.

In the IOC 240, a logic circuit which supplements the function of the CPU 210 and handles the interface with the various peripheral circuits, is made up of gate array and custom LSI, or the like. According to this arrangement, the IOC 240 captures the input date from the keyboard 4 and control data to the internal bus 250 and outputs to the driving section 150, in interlocking with the CPU 210, the data and control signals outputted from the CPU 210 to the internal bus 250 as they are or with due processing.

According to the above-described arrangement, the CPU 210 inputs various control signals and data from various sections of the tape printing apparatus 1 based on the control program inside the ROM 220. Further, the CPU 210 processes various data based on the various inputted signals and data to output it into various sections of the tape printing apparatus 1 through the IOC 240, thereby performing control of the print-processing.

In concrete, when characters are inputted by the user though the keyboard 4, the CPU 210 temporarily stores the inputted characters into the input data block 232. Then, when the printing instruction is received through the keyboard 4, the data stored in the input data block 233 is developed to thereby generate the printing data to store them into the printing data block 233. The driving of the print-feeding motor 33 is started and, depending on the result of detection by the encoder 62, the printing is performed based on the printing data inside the printing data block 233. Thereafter, after feeding the tape by a predetermined length based on the printing data, half cutting is performed by the half cutter 42 depending on necessity and the end portion of the tape T is cut off by the full cutter 41. The printed tape T is then discharged out of the tape discharging port 8.

With reference to FIGS. 5A-5D, a description will now be made about the tape T according to this invention.

Figure 5A:
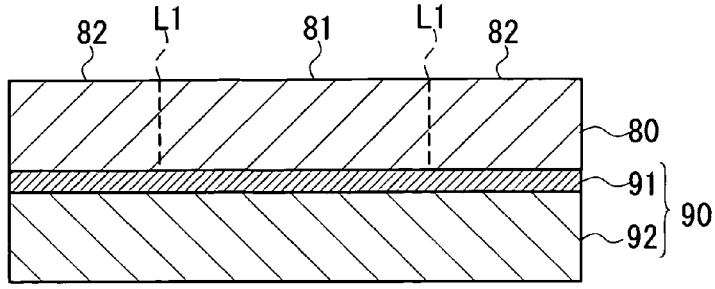
FIGS. 5A through 5C are sectional views of a printing tape and FIG. 5D is a plan view thereof.
Figure 5B:
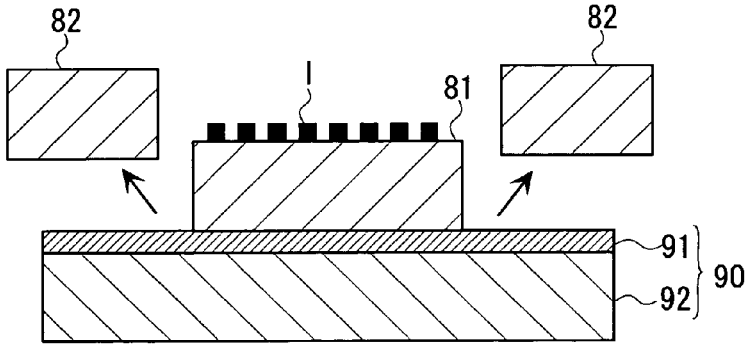
Figure 5C:
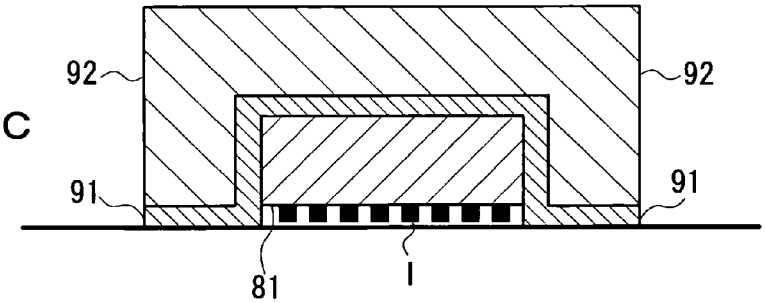

FIGS. 5A-5C are schematic sectional views of the tape T. The tape T has a recording tape layer 80 whose face (upper side as seen in FIG. 5A) is used as a recording surface, and a transparent pseudo-laminating layer 90 which is adhered to the back (i.e., lower side as seen in FIG. 5A, which lies opposite to the recording surface) of the recording tape layer 80. The recording tape layer 80 and the transparent pseudo-laminating layer 90 are made of a thin tape material such as polyethylene terephtalate (PET). Although not illustrated, plural kinds of printing tapes are prepared.

The face of the recording tape layer 80 is subjected to coating so as to improve the stay of the ink I. Long-side cutting lines L1, L1 which are parallel with each other and are formed along the longitudinal direction of the tape are formed. As a result of forming the long-side cutting lines L1, L1 the recording tape layer 80 is divided into a recording tape piece 81 whose surface serves as the printing region and a pair of cut-off pieces 82, 82 which serve as the release pieces of the adhesive-agent layer 91 (see FIG. 5B).

On the other hand, the pseudo-laminating layer 90 is provided on the face-side (as seen in the tape T) with an adhesive-agent layer 91 and on the back-side (as seen in the tape T) with a transparent tape layer 92. The tape T having printed thereon is inverted upside down (inside out). As a result, the transparent layer 92 serves as the laminate tape relative to the recording surface which is formed on the recording tape piece 81. In this specification, the upper side as illustrated in the relevant figures is normally referred to as "face" and the lower side as illustrated is normally referred to as "back" unless specifically defined otherwise.

Figure 5D:
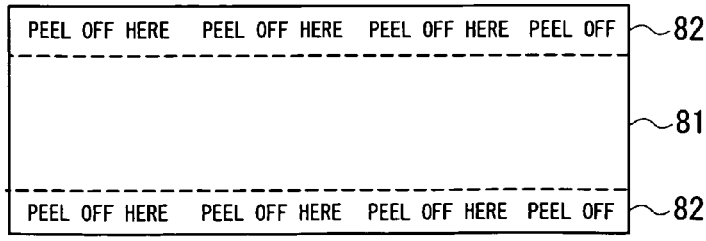

On the surface of each of the cut-off pieces 82, 82, there is printed operating information to the effect that the cut-off pieces 82, 82 shall be peeled off (FIG. 5D). According to this arrangement, the wrong peeling operation can be prevented. This operating information printed on the surface of the cut-off pieces may be printed by the printing apparatus 1. In addition, the long-side cutting lines L1 may be formed in a single line. According to this arrangement, either left side and the right side, as seen in the widthwise direction in the figure, of the printed and cut tape is used for adhering, whereby it serves as a tag to be attached to another object.

Figure 6A:
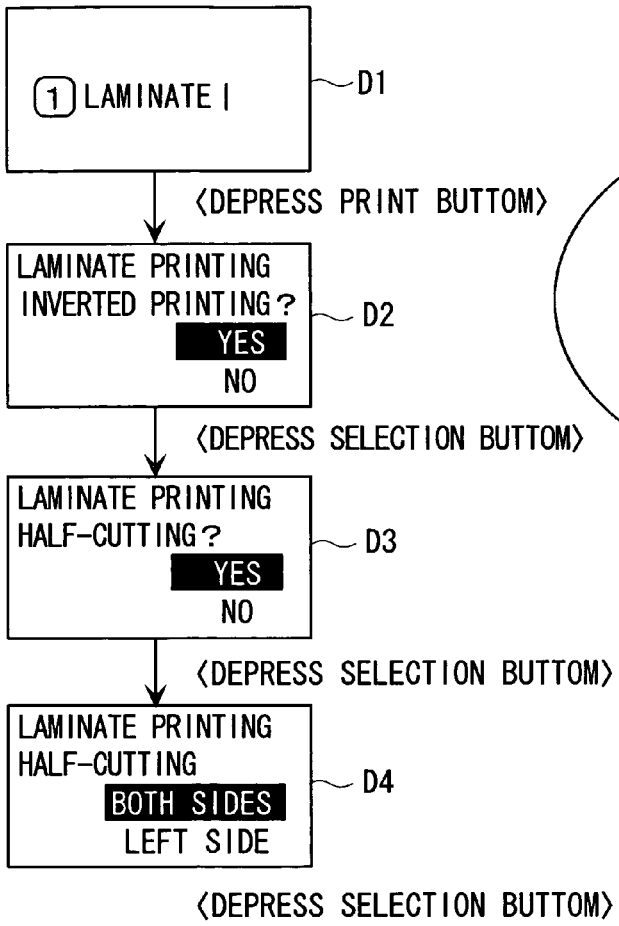
FIGS. 6A through 6C are schematic views showing transfer of screen in laminate printing of the tape printing apparatus.
Figure 6B:
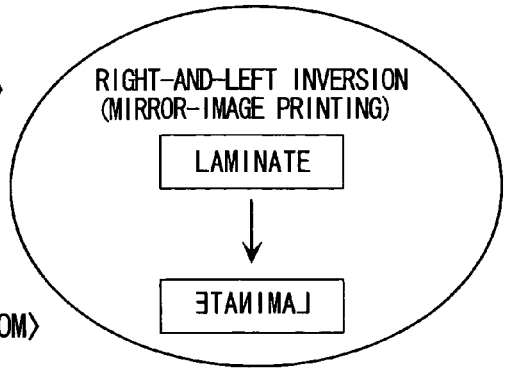

A description will now be made, with reference to FIGS. 6A-6C, about the laminate-printing function to print on the tape T.

In an ordinary editing screen (screen D1), the user inputs the character (the character of "LAMINATE" in this example) and then depresses the print button. Then, as described above, the tape printing apparatus 1 detects the kind of tape T (tape cartridge C) by the tape recognition sensor 61 in the detection section 140. The tape printing apparatus 1 then detects that the tape T is a pseudo-laminating tape and sets the printing region in the tape widthwise direction (print-width region) to the width Phi of the print recording piece 81 (see FIG. 6C). Then, a display is made of a screen to ask whether an inverted printing (or mirror-image printing) shall be performed or not (i.e., whether the character string ("LAMINATE") shall be inverted in the right-and-left direction) (screen D2).

In the screen to select whether the inverted (mirror-image) printing shall be performed or not, if the inverted printing is designated by the user (screen D2; Yes), the CPU 210 inverts the inputted data stored in the input data block 232, i.e., character string "LAMINATE" is inverted in the right-and-left direction to thereby perform processing to generate the printing data (FIG. 6B). In case the tape T is adhered to the inside of a window pane, or the like, so as to make it visually recognizable through a transparent glass, the character string is not inverted, but may be printed as an ordinary true image. On the other hand, in the display screen, a display is made of a screen to ask the user to select as to whether half-cutting is subsequently to be performed or not (screen D3). This half-cutting operation is to form short-side cutting line or lines L2 by cutting the printing-tape layer 80 in the widthwise direction of the tape T at a point or points outside the character string as seen in the longitudinal direction of the tape T. If the user selects to perform half cutting (screen D3; Yes), display is made to urge selection of the position at which half cutting is performed (screen D4).

As the position at which half cutting is performed, one of the following can be selected, i.e., "both sides", "left side", and "right side" (on screen D4, "both sides" is selected). Once the position of half cutting is selected by the user, the printing apparatus 1 starts print-processing and thereafter performs half-cutting of the tape T, followed by full cutting thereof, and finally performs discharging thereof out of the tape printing apparatus 1.

Figure 6C:
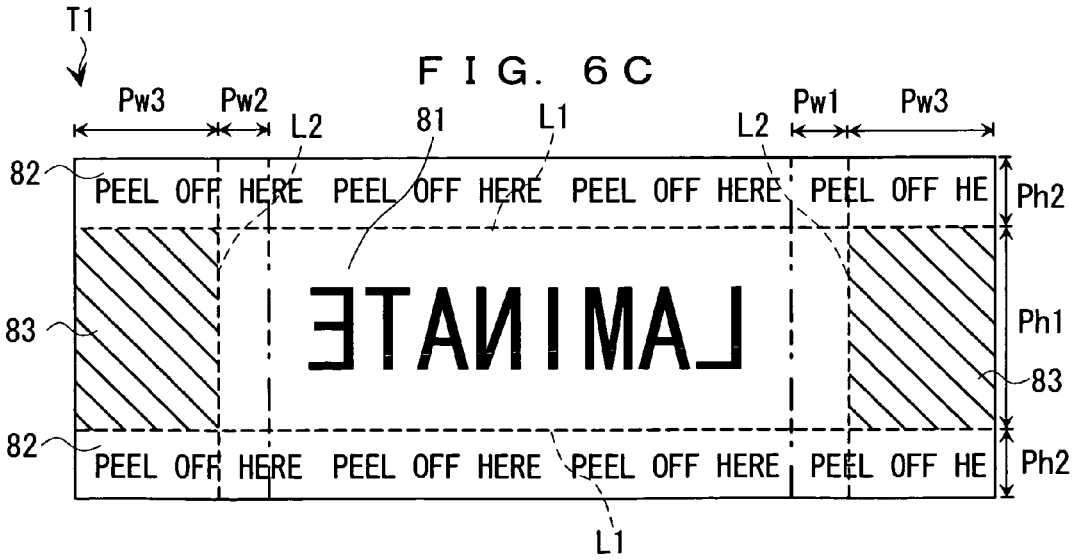

The tape T1 shown in FIG. 6C shows a printing tape in which the character string "LAMINATE" is printed on the print-recording piece 81 in a right-and-left inverted manner (mirror-image printing), the short-side cutting lines L2, L2 are formed at two points outside the character string as seen in the longitudinal direction of the tape T1, the tape T1 is subjected to full cutting, and is discharged out of the tape printing apparatus 1.

The tape printing apparatus 1 performs printing of the operating information relating to the peeling operation on the waste margins (half-cutting margins 83, 83), along with the printing of the character string. The tape printing apparatus 1 is provided with the printing data as operating information inside the above-described ROM 220. Based on the position of the short-side cutting lines L2, L2, the operating information is printed. As the operating information, there may be printed not only characters but also patterns such as symbols and background patterns (in the figure, shading is printed). The operating information to be printed on the cut-off pieces 82, 82 may also be printed by the tape printing apparatus 1.

The tape printing apparatus 1 sets the print-width region as the width Phi of the print-recording piece 81 and also prints the inputted character string "LAMINATE" in the print-width region Phi so as to be positioned in the center thereof. In front and rear of the character string "LAMINATE" are printed front waste margin and rear waste margin having a width of PW1, Pw2, respectively (actually tape is fed by the length equivalent to the waste margin). The width Pw1 of the front waste margin and the width Pw2 of the rear waste margin may be arbitrarily set by the user, and the waste margin data about the waste margin length is stored in the print-data block 233.

In the printing tape T, the ratio between the width Ph1 of the print-recording piece 81 and the width Ph2 of the cut-off pieces 82, 82 is set to be about 2:1. According to this arrangement, the printing region and the waste regions are formed at an appropriate ratio. Further, the half-cutting margins 83, 83 having the width of Pw3 are formed in a pair by the short-side cutting lines L2, L2. The half cutting is performed such that the width Pw3 of the half-cutting wastes 83, 83 becomes about two times the width Ph2 of the cutting pieces 82, 82. This arrangement is to strengthen the adhesive force of the half-cutting margins 83, 83 which are shorter in the long-side direction than the cut-off pieces 82, 82.

An alternative arrangement may be made such that the width Pw3 of the half-cutting margins 83, 83 are also directly designated by the user. In this case, it is necessary to set in advance the minimum value of the half-cutting margins on the part of the apparatus.

Alternatively, the position of half cutting may also be directly designated by the user in the same manner as the length of the waste margin. For example, designation may be made by inputting numerical value of, e.g., "10 mm" from the front waste margin or from the rear waste margin.

With reference to FIGS. 7A-7D, a description will now be made about the peeling operation and adhesion operation of the printed and cut tape T1.

Figure 7A:
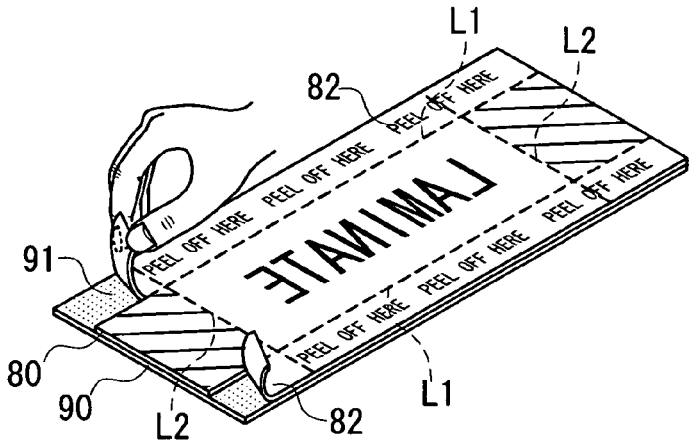
FIGS. 7A through 7D are explanation views showing peeling and adhering operations of the printing tape.
Figure 7B:
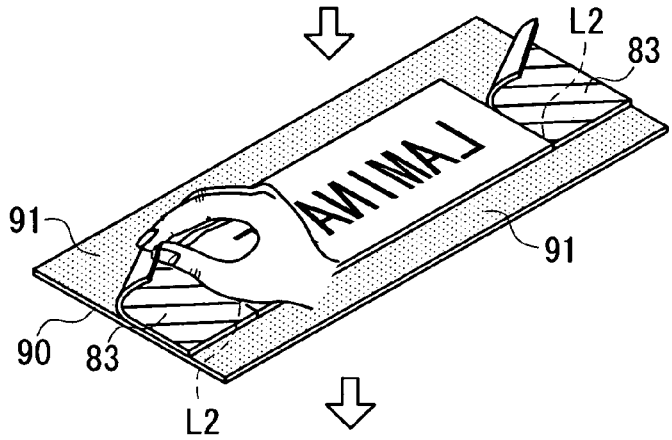
Figure 7C:
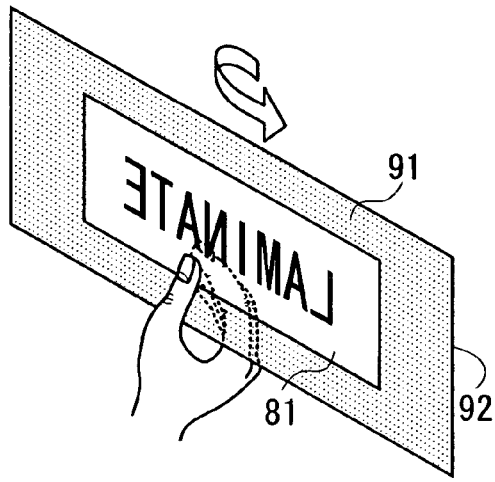
Figure 7D:
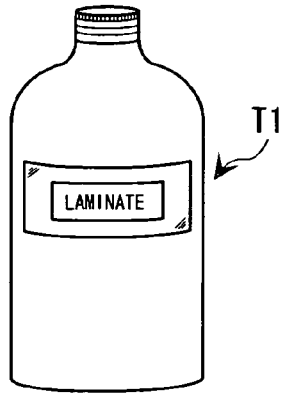

First, the cut-off pieces 82, 82 are respectively separated or peeled off from the adhesive-agent layer 91 of the pseudo-laminating layer 90 to thereby separate them off along the long-side cutting lines L1, L1 (FIG. 7A). Then, the half-cutting margins 83, 83 are separated or peeled off from the adhesive-agent layer 91 on the face of the pseudo-laminating layer 90 (FIG. 7B). Thereafter, the tape T1 in a state in which the adhesive-agent layer 91 is exposed is inverted in the right-and-left direction (i.e., inverted inside out) (FIG. 7C), and is adhered to the object of adhesion with the adhesive-agent layer serving as the adhesion surface (FIG. 7D). In a state in which the tape T1 is adhered, the recording surface on which the character string "LAMINATE" is printed is laminated by the transparent tape layer 92 of the pseudo-laminating layer 90.

An arrangement may also be made in which the half-cut processing to form the short-side cutting lines L2, L2 are formed is omitted. In case the half-cut processing is not performed, the half-cutting margins 83, 83 are not formed and therefore the adhesive force of the tape T may be smaller than the one with the half-cut processing. This arrangement, however, has an advantage in that the length of the tape T can be saved.

The short-side cutting lines L2, L2 to form the half-cutting margins 83, 83 may be formed after the cut-off pieces 82, 82 have been separated. In other words, an arrangement may be made such that only the print-recording piece 81 is subjected to half cutting. According to this arrangement, since the long-side cutting lines L1, L1 and the short-side cutting lines L2, L2 do not cross each other, the peeling operation becomes easy. In this case, the control becomes easier if a sliding type of half cutter is used instead of a scissors-type of half cutter.

In case the printing is made on the printing tape T, there may be performed an upside-down printing in which each character is printed upside down, aside from the ordinary printing and right-and-left inverted printing (mirror-image printing). In this case, by adhering the printed and cut tape T in a manner both inverted inside out and upside down, the printed character becomes ordinary (true image) in a state of being adhered, whereby it can be easily recognized.

What is claimed is:

1. A tape printing apparatus in combination with a printing tape, said printing tape having:

a translucent recording-tape layer having a recording surface on a face thereof; and a translucent pseudo-laminating layer adhered to a back of said recording-tape layer, said pseudo-laminating layer having an adhesive-agent layer on a face thereof and a translucent tape layer on a back thereof, said recording-tape layer having a print-recording piece whose face serves as a printing region and a cut-off piece to be peeled off from said adhesive-agent layer, said print-recording piece being separated from said cut-off off piece by a long-side cutting line formed in a longitudinal direction of said recording surface, said apparatus comprising:

input means for inputting character string made up of one or more characters to be printed on said recording surface;

data inverting means for inverting the inputted character string in a right-and-left direction;

printing means for printing on the printing region the character string as inverted by said data inverting means;

full-cutting means for cutting off only that portion of the printing tape on which the character string is printed; and half-cutting means for forming a cutting line by cutting the print-recording tape layer in the widthwise direction of the tape to thereby form a cutting line in a short-side direction of the tape, said cutting line being located outside the character string, as seen in the character-string direction, in the printed portion.

2. A tape printing apparatus in combination with a printing tape, according to claim 1, further comprising:

the printing tape in a state of being rolled into a roll; and a tape cartridge:

wherein the tape cartridge includes a cartridge case which houses said printing tape in a manner to be freely paid out therefrom.

3. The tape printing apparatus according to claim 1, wherein said printing means prints, in parallel with the printing of the character string, operating information about releasing operation on a face of one of the cut-off piece and a waste margin to be formed by the short-side cutting line.

4. The tape printing apparatus according to claim 3, wherein the operating information includes at least one of character information, symbol information, and background information.

* * * * *